US006688958B1

(12) United States Patent
Jones et al.

(10) Patent No.: US 6,688,958 B1
(45) Date of Patent: Feb. 10, 2004

(54) HAND SANDER

(76) Inventors: Clarence G. Jones, 8215 Highland Dr., Covington, GA (US) 30014; Suzanne Passarella, 8215 Highland Dr., Covington, GA (US) 30014

( * ) Notice: Subject to any disclaimer, the term of this patent is extended or adjusted under 35 U.S.C. 154(b) by 34 days.

(21) Appl. No.: 09/839,775

(22) Filed: Apr. 20, 2001

Related U.S. Application Data

(60) Provisional application No. 60/223,298, filed on Aug. 7, 2000.

(51) Int. Cl.[7] ..... B23F 21/03

(52) U.S. Cl. ..... 451/557; 451/345; 451/523; 451/524; 451/526; 451/527

(58) Field of Search ..... 481/345, 523, 481/524, 525, 526, 557; 451/345, 523, 524, 525, 526, 557

(56) References Cited

U.S. PATENT DOCUMENTS 4,930,267 A * 6/1990 Hill et al. ..... 451/354
5,054,248 A * 10/1991 Thayer ..... 451/524
5,382,189 A * 1/1995 Arendall ..... 451/557
6,186,878 B1 * 2/2001 Takizawa et al. ..... 451/357
6,296,558 B1 * 10/2001 Polle et al. ..... 451/557

* cited by examiner

*Primary Examiner*—Joseph J. Hail, III
*Assistant Examiner*—Shantese McDonald
(74) *Attorney, Agent, or Firm*—Kim S. Manson

(57) ABSTRACT

The present invention, in a preferred embodiment, is a new and improved hand-held manual sander that comprises a sander body, a hand grip, a mounting plate and a working surface. More specifically, the sander body includes a cylindrically shaped member designed to reduce fatigue to the hand during extended use of sander. The hand grip is adapted to the size of a palm for a single handed grip around the sander. A finger recess around the periphery of the hand grip portion is designed to further facilitate one-handed use. The mounting plate extends from the sander body. The working surface is associated with the bottom of the mounting plate. The outer periphery of the mounting plate substantially defines the size of the working surface and, therefore, the size of working materials such as sandpaper. The working surface consists of hook type materials of hook and loop mechanical attachment systems. The selection of products for the working materials may consist of but is not necessarily limited to a variety of surface preparation and finishing materials having attaching surfaces adapted to one or more hook and loop style interlocking surface devices.

3 Claims, 3 Drawing Sheets

HAND SANDER

CROSS-REFERENCE TO RELATED APPLICATIONS

This application is entitled to the benefit of Provisional Patent Application Serial No. 60/223,298 filed Aug. 7, 2000.

TECHNICAL FIELD

The present invention relates generally to manual hand tool for sanding and finishing the surface of a workpiece and, more specifically, to a tool which allows quick exchange of sanding and finishing materials.

BACKGROUND ART

Hand sanders are used in conjunction with sandpaper and other materials for purposes of removing paint, rust and other undesirable surfaces. They are also used to finish or polish the surfaces of items constructed of metal, wood, plastics and various other materials. One very common way to sand a workpiece is to use a sanding block. Most prior art manual sanding blocks include a working surface over which the sandpaper or other material is wrapped. The block may also include a handle to facilitate gripping the block during use. Manual sanders, ie., non-mechanized sanders, are particularly utilized when maximum control over sanding pressure is desired, such as in model-making, doll-making and other hobbies and crafts. Manual sanders also provide a less expensive alternative to mechanized sanders.

Manual sanders often are constructed to maximize available working surface area and result in working surfaces of two to four times the size of the user's hand. It is important to note, however, that since manual sanders rely on the force or pressure from the user's hand, much of the larger working surface area is not efficiently utilized because the hand does not reach all areas of the working surface. The efficient use of primary working materials such as sandpaper, polishing sheets or buffing cloths directly impact user costs. Sections of working material that are not used during sanding or finishing are simply wasted if the material cannot be rotated to correspond to the pressure points of the sander. If the working material is rotated, the user must use valuable time to adjust the working material to maximize the use of surface area of the material. Alternatively, the user must change the working material more often than is necessary and waste unused material.

Manual sanding blocks often result in fatigue when used over extended periods because the user must place his or her hands in unnatural, uncomfortable positions to use the sander or the user must use both hands to effectively control the large surface area of the sander. One example of such a manual hand sander design may be found by reference to U.S. Pat. No. 5,054,248 to Thayer. In the Thayer design, the leading ends of the sander extend from the handle in different lengths and thicknesses. In order to effectively use the extended ends of the sander, one hand must be used to hold the sander while the other hand is used to apply pressure to the extended ends. Such designs are especially difficult to use by woman or children who tend to have smaller or weaker hands or by people who suffer from arthritis or other limiting conditions.

In an attempt to overcome these deficiencies, manual sanders which minimize the time needed to change working material have been proposed. Examples of such devices may be found by reference to U.S. Pat. No. 2,809,476 to Bourdunis, U.S. Pat. No. 3,123,947 to Rawley and U.S. Pat. No. 4,944,128 to Reiter. Such designs utilize spring loaded clamps to hold sheets or strips of working materials taut against the body of the sander. These designs do not, however, fully utilize a sheet or strip of working material but merely operate to change sheets more quickly than other designs. Further, if a different grade of material is required, the entire roll or sheet of working material must be removed from the spring loaded device and replaced. If the user must switch between grades of material multiple times, the process clearly becomes time consuming.

However, in light of the present invention, the aforementioned designs are deficient in that they do not, in combination, fully utilize working materials and provide quick and easy interchange of work materials. Further, extended use of prior art sanders results in increased hand and body fatigue.

BRIEF SUMMARY OF THE INVENTION

Briefly described, in a preferred embodiment, the present invention overcomes the above-mentioned disadvantages by providing a hand-held manual sander that utilizes a natural, comfortable hand position which encompasses the entire sander within the hand of the user and, in effect, makes the sander an extension of the user's hand. Because the working surface area is not extended beyond the control of the hand, waste of working material is minimized. The present invention, therefore, provides a comfortable, secure grip and maximum control over the force and pressure exerted on the workpiece. The present invention reduces fatigue during use since the hand is placed in a natural, unextended position. This feature is especially useful for people with small or weak hands. Further, the present invention allows the user to quickly change working materials to suit the needs of the workpiece.

Generally, the present invention, in the preferred embodiment, comprises a sander body, a hand grip, a mounting plate and a working surface. More specifically, the sander body includes a generally cylindrically shaped member designed to reduce hand fatigue during extended use of the sander. The hand grip is adapted to the size of a palm for a single handed grip around the sander. A finger recess around the periphery of the hand grip portion is designed to further facilitate one-handed use. The mounting plate extends from the sander body. The working surface is associated with the bottom of the mounting plate. The outer periphery of the mounting plate substantially defines the size of the working surface and, therefore, the size of working materials such as sandpaper.

The working surface consists of hook type materials of hook and loop mechanical attachment systems. The working surface is bonded to the base of the mounting portion by adhesion such as cement or pressure sensitive adhesive. A circular sheet of working material is releaseably attached to the working surface of the sander body. The selection of products for the working materials may consist of but is not necessarily limited to a variety of surface preparation and finishing materials having attaching surfaces adapted to one or more hook and loop style interlocking surface devices.

A feature and advantage of the present invention is to provide a new and improved hand-held manual sander which permits the quick and easy interchange of working materials such as sanding, finishing or polishing sheets.

Another feature and advantage of the present invention is to provide a new and improved hand-held manual sander which minimizes discomfort to the user when used over extended periods of time.

Another feature and advantage of the present invention is to provide a new and improved hand-held manual sander which accommodates a small or weak hand of a user.

Still another feature and advantage of the present invention is to provide a new and improved hand-held manual sander which maximizes the use of the entire surface of the sheet of the working material.

Yet another feature and advantage of the present invention is to provide a new and improved hand-held manual sander which increases the efficiency of the sander by aligning the forces of the hand directly to the surface of the workpiece.

Still another feature and advantage of the present invention is to provide a new and improved hand-held manual sander which may be easily manufactured.

A further feature and advantage of the present invention is to provide a new and improved hand-held manual sander which may be produced at a low cost of manufacture with regard to materials and labor, thereby making the manual sander economically available to the buying public.

These and other objects, features and advantages of the invention will become more apparent to one skilled in the art from the following description and claims when read in light of the accompanying drawings.

DETAILED DESCRIPTION OF PREFERRED AND ALTERNATE EMBODIMENTS

In describing the preferred embodiment of the present invention as illustrated in the figures, specific terminology is employed for the sake of clarity. The invention, however, is not intended to be limited to the specific terminology so selected, and it is to be understood that each specific element includes all technical equivalents that operate in a similar manner to accomplish similar functions.

With regard to all such embodiments as may be herein described and contemplated, it will be appreciated that optional features, including, but not limited to, aesthetically pleasing coloration and surface design, and labeling and brand marking, may be provided in association with the present invention, all without departing from the scope of the invention.

Figure 1:
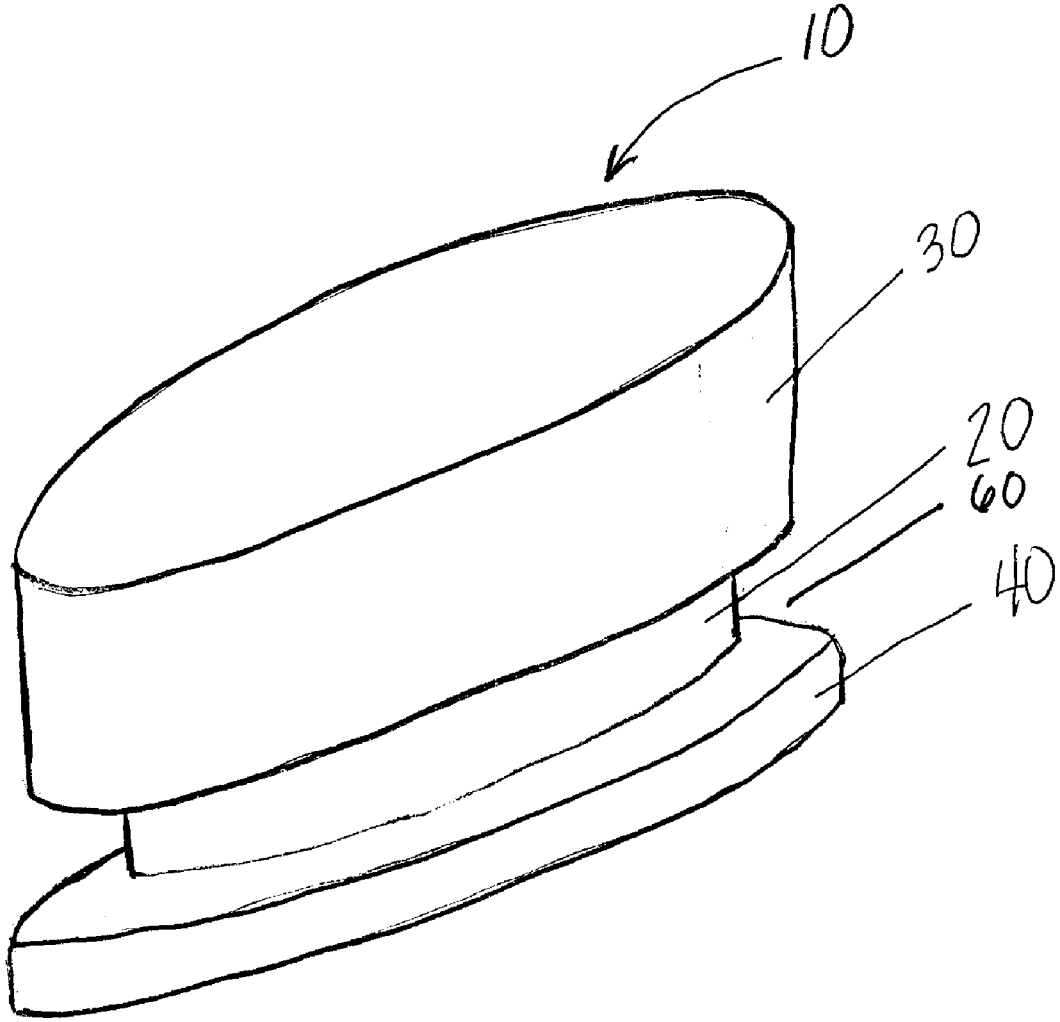
FIG. 1 is a perspective view of the present invention according to a preferred embodiment.
Figure 2:
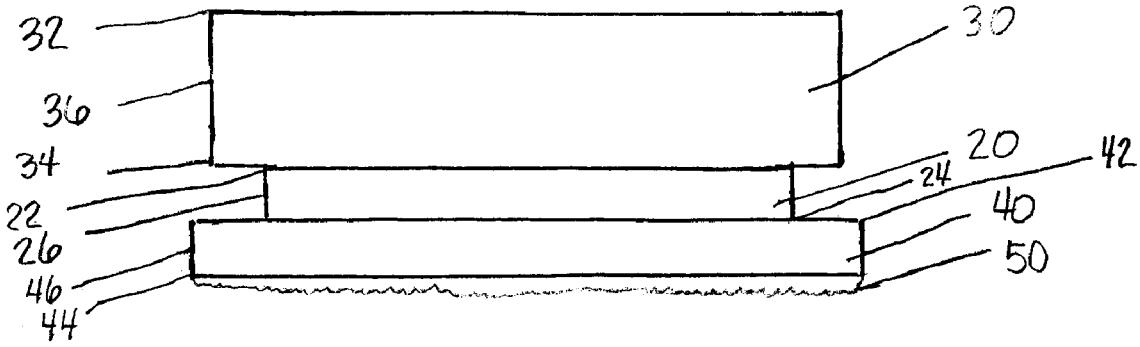
FIG. 2 is a side elevational view of the present invention according to a preferred embodiment.

Referring now to FIGS. 1 and 2, hand-held manual sander 10 generally comprises sander body 20, hand grip 30, mounting plate 40 and working surface 50. More specifically, sander body 20, hand grip 30 and mounting plate 40 comprises concentric, vertically oriented cylindrical members of varying diameters. Mounting plate 40 comprises a flattened cylindrical member of a diameter larger than the diameter of hand grip 30, while sander body 20 has a diameter smaller than the diameter of hand grip 30.

Sander body 20 comprises a flattened cylindrical member having top surface 22, bottom surface 24 and outer rim 26. Sander body 20, hand grip 30 and mounting plate 40 are constructed of rigid material, preferably wood or wood fibers. Alternatively, sander body 20, hand grip 30 and mounting plate 40 may also be constructed of polymeric materials or any material known within the art.

Hand grip 30 is generally cylindrical in shape and is defined by top surface 32, bottom surface 34 and outer rim 36. Top surface 32 is a circular, flat surface and is adapted to a palm grip of the user. Outer rim 36 is sized to allow the user's fingertips and thumb to firmly grasp hand grip 30. Bottom surface 34 of hand grip 30 is fixedly attached to top surface 22 of sander body 20 preferably by gluing. However, any known means within the art may be employed to adhere hand grip 30 to sander body 20.

Mounting plate 40 comprises top surface 42, bottom surface 44 and circular rim 46. Top surface 42 of mounting plate 40 acts as a rest for ends of the user's fingers and prevents the fingers and thumb from contacting the surface of the workpiece. Bottom surface 24 of sander body 20 is fixedly attached by gluing, preferably or any known means within the art to top surface 42 of mounting plate 40.

Recess 60 is formed between bottom surface 34 of hand grip 30 and top surface 42 of mounting plate 40 and is further defined by outer rim 26 of sander body 20. Recess 60 allows the user's fingers to grasp outer rim 36 of hand grip 30 along bottom surface 34 to achieve a firm hold on manual sander 10.

Figure 3:
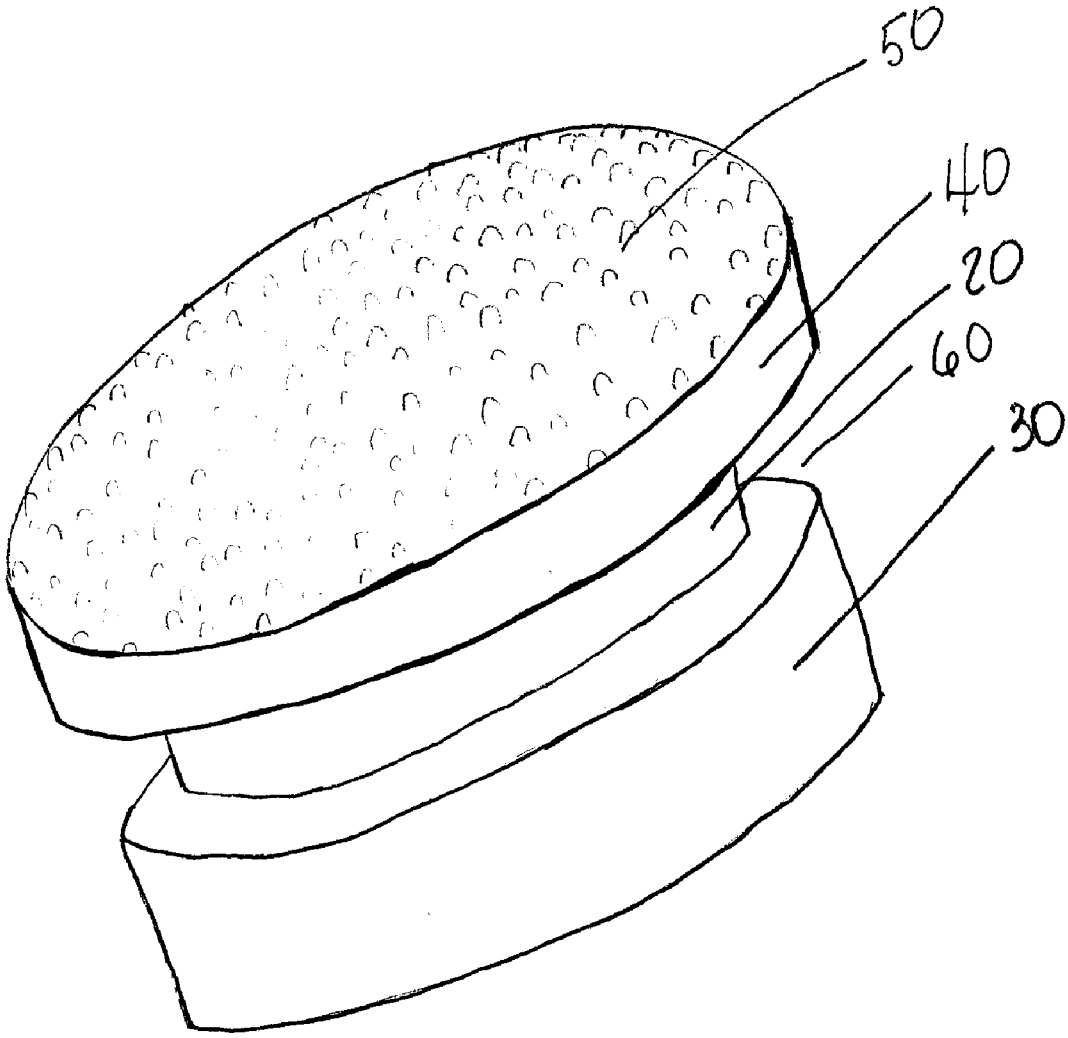
FIG. 3 is a detailed view of the mounting plate and working surface of the present invention according to a preferred embodiment.

As shown in FIG. 3, working surface 50 is associated with bottom surface 44 of mounting plate 40 and is defined by the outer periphery of mounting plate 40. Working surface 50 comprises mechanical hook type material, as employed in various hook-and-loop mechanical attachment systems, for use as the gripping surface for a variety of surface preparation and finishing products having attaching surfaces adapted to one or more such hook or mushroom style interlocking surface devices.

An alternative use of manual sander 10 is as a personal hygiene device. The sander 10 may be used to remove dead skin from feet or hands or other areas of the body where skin may thicken and harden. Because manual sander 10 can be held in a comfortable, natural hand position, the sander facilitates use during extensive removal time for multiple layers of hardened skin. For this alternate use, manual sander 10 would be constructed of water resistant material such as plastic or hardened rubber. The working material for this alternative use includes pumice or materials with the qualities of pumice.

Having thus described exemplary embodiments of the present invention, it should be noted by those skilled in the art that the within disclosures are exemplary only, and that various other alternatives, adaptations, and modifications may be made within the scope of the present invention. Accordingly, the present invention is not limited to the specific embodiments illustrated herein, but is limited only by the following claims.

What is claimed is:

1. A hand-held manual sander comprising:

a body composed of rigid material, said body having a top face, bottom face and outer edge;

a generally cylindrical handle adapted to be grasped one-handedly by a user and adapted to fit within palm grip of user;

a generally cylindrical mounting plate having a bottom surface and an outer rim; and a working surface associated with said bottom face of said mounting plate and further defined by said outer rim of said mounting plate wherein said handle is fixedly attached to said top face of said body and said mounting plate is fixedly attached to said bottom face of said body.

2. The hand-held manual sander of claim 1 wherein said working surface includes means for attaching a surface finishing material.

3. The hand-held manual sander of claim 2 wherein said means for attaching is a hook-and-loop fastener system.

* * * * *